United States Patent [19]

Riggins

[11] 4,277,719

[45] Jul. 7, 1981

[54] POWER SPARK GAP FOR HIGH CURRENT CONDUCTION

[75] Inventor: Oral L. Riggins, Odon, Ind.

[73] Assignee: Westinghouse Electric Corp., Pittsburgh, Pa.

[21] Appl. No.: 59,403

[22] Filed: Jul. 20, 1979

[51] Int. Cl.[3] ..... H01J 17/00; H01J 21/00

[52] U.S. Cl. ..... 313/325; 313/214; 361/127

[58] Field of Search ..... 313/325, 214; 361/127, 361/128, 133; 315/36

[56] References Cited

U.S. PATENT DOCUMENTS

| | | | |
|---|---|---|---|
| 2,828,436 | 3/1958 | Marbury | 313/325 X |
| 3,252,038 | 5/1966 | Calvesbert et al. | 313/325 X |
| 3,317,777 | 5/1967 | Algar et al. | 313/325 X |
| 3,513,516 | 5/1970 | Oddo et al. | 325/313 X |
| 4,011,485 | 3/1977 | Cunningham | 361/127 |
| 4,020,398 | 4/1977 | McKnight | 361/127 |

*Primary Examiner*—Saxfield Chatmon, Jr.
*Attorney, Agent, or Firm*—G. H. Telfer

[57] ABSTRACT

Power gaps for protection of electrical equipment against overvoltages and having high current handling capacity consisting of two carbon electrodes mounted in an arrangement in which the lower cylindrical electrode has an inner conductive sleeve reaching proximate to but spaced from the end of the electrode for providing a centrally located, relatively stable, low resistance path for the arc current.

4 Claims, 1 Drawing Figure

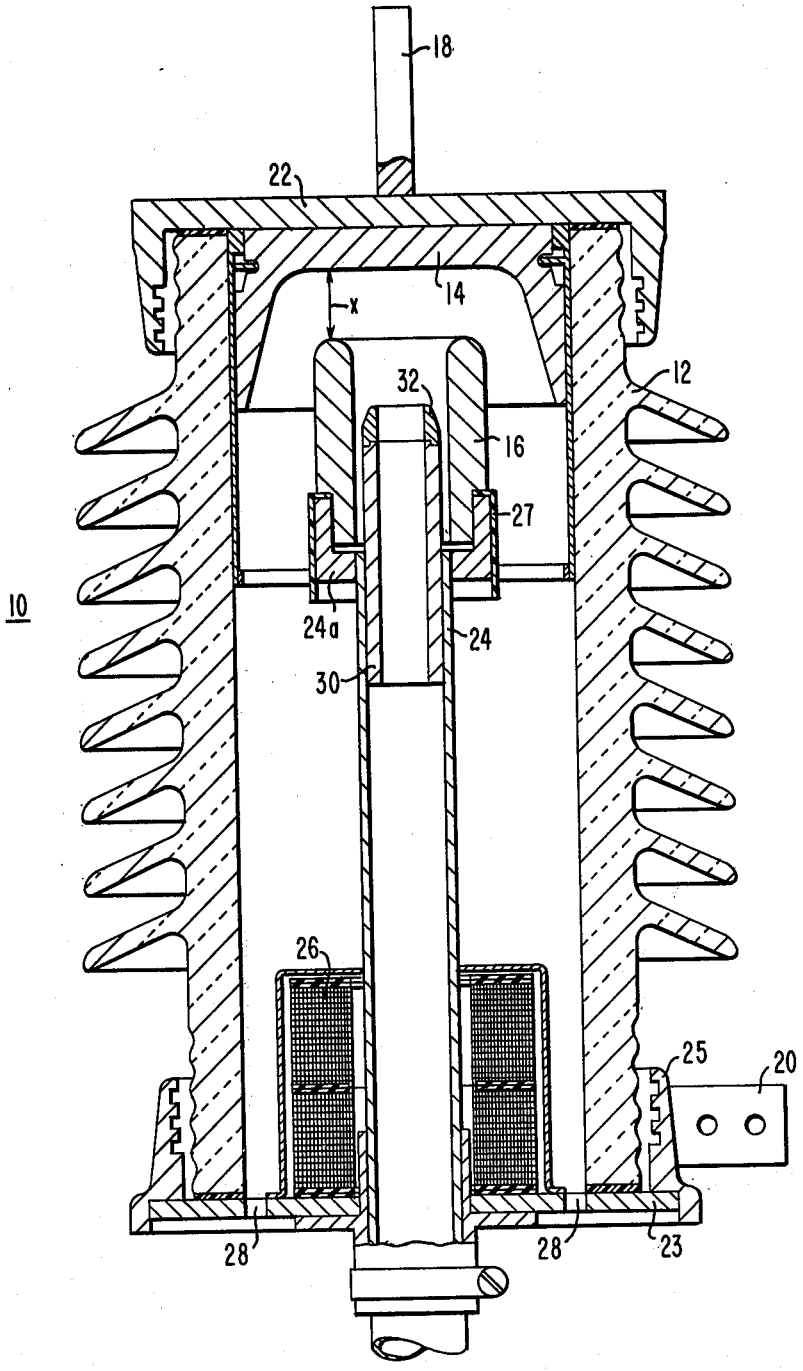
18
22
14
x
12
32
16
27
10
24a
24
30
26
25
20
28
28
23

POWER SPARK GAP FOR HIGH CURRENT CONDUCTION

BACKGROUND AND SUMMARY OF THE INVENTION

Spark gaps are generally known types of devices for use as voltage limiters or surge suppressors. Upon a predetermined voltage being applied to the electrodes of the spark gap an arc is initiated therebetween that conducts current and maintains a predetermined voltage level across a protected electrical device. In certain applications of spark gaps very large quantities of current are required to be conducted and this is desirably to be done in a compact and economical device. Also, the device is intended to be capable of repeated operation over a long period of time so that it is important that its characteristics be consistent.

Power gaps of the type to which the present invention is particularly directed have been previously used, for example, to protect series capacitors from overvoltages due to faults or lightning surges on transmission lines. These devices normally consist of two carbon electrodes mounted in an insulating, typically porcelain, enclosure with means provided for the introduction and exhaust of an air (or other gas) blast as the extinguishing medium of the arc. The electrodes used include a top electrode of approximately an umbrella configuration under which is located the bottom electrode in the form of a cylindrical sleeve. The end of the sleeve is spaced a predetermined striking distance from the upper portion of the top electrode at which the arc is initiated. The cylindrical configuration of the bottom electrode permits extinguishing air to be admitted into the enclosure around it and exhausted through the center of the bottom electrode.

Spark gaps as described have been successfully made and used in moderate sizes with capacity up to about 15,000 amperes of fault current. However, a phenomemon is encountered that generally influences power gaps and that is a tendency for the arc after initiation to bow out and transfer to elements other than the carbon electrodes. This tendency may be generally thought of as a seeking of the lowest resistance path between the ultimate conductors connected to the electrodes.

To combat this problem, the present invention uses generally the same configuration as described above with a sleeve of highly conductive material located within the bottom electrode. The arcing tip at the end of this sleeve is disposed near the end of the electrode but is spaced within it a distance, typically approximately equal to the spacing of the first and second electrodes, so the carbon is still subjected to the major impact of arcs. The inner sleeve ensures the arc will travel to the inside of the electrode and be confined there where a desirable conductive material can be used with good lifetime. This has been found to insure that up to considerably higher current levels, such as about 41,000 amperes as compared to structures that previously could carry up to about 15,000 amperes, that the arc will be held at the proper surfaces and that there will be not substantial deterioration of performance.

The arcing tip of the conductive sleeve is preferably a durable conductive material such as Elconite alloy, principally an alloy of silver and tungsten.

Spark gaps in series capacitor protection equipment encounter high current levels because of the large amount of energvy stored in the system that is to be discharged upon occurrence of a fault. For the sake of achieving required performance, a practical constraint has been placed on where the capacitors and their protective gaps are placed in relation to the transmission line. In general, higher fault currents can occur from equipment near the ends of transmission lines than in the middle because less benefit is derived from the impedance of the transmission line itself. Therefore, it has been desirable to work in the middle of the transmission line. There can be occasions, however, where this is unfavorable for the overall system and it would be preferred to be able to work near the end of the line. For example, in one actual system, the magnitude of fault currents near the end of the line can be expected to reach about 40,000 amperes while near the middle of the same line maximum faults of only up to about 7,000 amperes are reached. The present invention provides a power spark gap that gives system design flexibility so that the location of the equipment need not be confined to the middle of the line.

BRIEF DESCRIPTION OF THE DRAWING

The single FIGURE is a cross sectional view of an embodiment of the present invention.

DESCRIPTION OF THE PREFERRED EMBODIMENT

Referring to the single FIGURE there is shown a power spark gap assembly 10 comprising a porcelain tube 12 within which are located first and second electrodes 14 and 16 that are electrically arranged respectively in association with first and second external electrode terminals 18 and 20. The first or upper electrode 14 is disposed at the extreme upper end of the structure and has a surface in intimate association with an upper plate 22 of conductive material enclosing the upper end of the porcelain tube 12. The upper electrode 14 has a generally umbrella configuration so that it extends a distance down the sides of tube 12.

The second or lower electrode 16 is of an open cylindrical configuration. Both electrodes 14 and 16 are comprised of carbon or a carbonaceous material but are connected to other, more conductive, elements. The second electrode 16 is supported on a copper tube 24 to which it is joined. The copper tube 24 extends to the lower end of the enclosure where it is joined to a conductive plate 23 communicating with a conductive flange 25 and the lower terminal 20. Over part of the support tube 24, there is disposed a insulating sleeve or arc shield 27, such as of Teflon material, so as to minimize the possibility of occurrance of arcing between that portion of the tube 24 and the lower skirt of the first electrode 14.

In the lower part of the enclosure are disposed one or more current transformers 26 that are present for the purpose of sensing the occurrence of an arc causing conduction through the tube 24. Upon sensing the occurrence of an arc, air blast equipment can provide an air (or other gas) blast to enter the enclosure through the apertures 28 in the lower end which is exhausted through the center tube 24 of the device.

The apparatus so far described is generally in accordance with prior practice. The arrangement in which the copper tube 24 runs from the lower end of the device up to the electrode 16 and supports it on a flanged extension **24*a*, in the absence of the inner sleeve 30, is one in which the performance suffers limitations. Upon arc initiation at the tip of the electrode 16 to the closest adjacent portion of the first electrode 14, the arc will tend to move upon increasing current being drawn. Generally, this means the arc bows out and travels down the outer surface of the electrode 16 and the lower extending portion or skirt of the first electrode 14. Eventually, if the current gets large enough, the arc strikes the outer surface of the tube 24** subjecting it to damaging erosion and also, because of the metal vapor produced, making the arc more difficult to extinguish.

By this invention, an inner sleeve 30 of highly conductive material is located just inside electrode 16 near its upper end. Sleeve 30 is joined to the inner surface of support tube 24. The character of the materials used influences the manner in which the device performs. Unfortunately, the qualities of high durability to arcs and high conductivity do not tend to go together for readily available and economical materials. The electrodes 14 and 16 themselves are chosen of a more durable material (e.g. carbon) but the current they carry is transferred to a higher conductivity, less durable, material such as copper or aluminum. In the present invention the inner sleeve 30 (the major portion of which is, for example, copper) permits the arc to be more confined and the end 32 of the sleeve is preferably of a higher durability material (such as a silver-tungsten alloy), though somewhat less conductive than the major portion of the sleeve and the support tube 24. Thus, the invention utilizes existing materials in a new arrangement that results in a major improvement in gap performance and life.

Merely for purpose of example, a device having a sparkover voltage of about 50,000 v. may be provided with an upper electrode 14 having a diameter of about 11 in. (28 cm.), a lower electrode of about 5 in. (13 cm.) outside diameter and a gap x between them of about 2 in. (5 cm.). The gap distance may be varied higher or lower to achieve some other desired sparkover voltage. With a gap setting of 2.0 in. it was found empirically that a suitable location for the upper extremity of arcing tip 32 was about 2.4 in. (about 6.0 cm.). This was determined by moving the sleeve 30 far enough down until it was located where the arc was reliably initiated at the carbon electrode 16, rather than the arcing tip 32, and yet the arc reliably moved to the arcing tip afterwards. In general it is considered the arcing tip 32 should be located approximately the same distance inside the end of electrode 16 as the shortest gap between the two electrodes, plus or minus 40%.

What we claim is:

1. A power spark gap for conduction of high currents upon occurrence of an overvoltage comprising: a pair of electrodes, one of said pair of electrodes comprising a cylindrical body of electrode material spaced a first distance from the other of said pair of elelctrodes and an inner sleeve of more highly conductive material located within said cylindrical body and spaced farther than said first distance from said other electrode, said inner sleeve having the capability of conducting higher currents than said cylindrical body and serving as means for receiving and substantially confining a high current arc that is initiated between said cylindrical body and said other electrode.

2. A power spark gap in accordance with claim 1 wherein: said cylindrical body of electrode material comprises a material having higher durability to arcs than the material of said inner sleeve and said sleeve is terminated at its end proximate said other electrode by a portion of higher durability than the remainder of said sleeve.

3. A power spark gap in accordance with claim 1 wherein: said electrodes are disposed within an enclosure having an external terminal electrically connected respectively with each electrode and said one electrode is supported on a tube of highly conductive material to which both said cylindrical body and said inner sleeve are in direct conductive engagement; and a gas blast arc extinction path is defined between apertures in said enclosure through the space between said electrodes and through the cylindrical electrode and support tube.

4. A power spark gap in accordance with claim 1 wherein: said inner sleeve terminates within said cylindrical body distance from the end of said body that is about equal to the shortest gap distance between said pair of electrodes, plus or minus 40%.

* * * * *